US006012896A

United States Patent [19]

Strohl

[11] Patent Number: 6,012,896

[45] **Date of Patent: *Jan. 11, 2000**

[54] PROCESS FOR PRODUCING A CONNECTION OF AN INSERT PART TO A TUBULAR PART BY MEANS OF FLANGING

[75] Inventor: Willi Strohl, Beilstein, Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,192

[22] Filed: Mar. 10, 1998

Related U.S. Application Data

[62] Division of application No. 08/699,931, Aug. 20, 1996, which is a continuation of application No. 08/519,664, Aug. 25, 1995, abandoned.

[51] Int. Cl.[7] ..... F04D 1/04; F04B 21/00; F04B 17/00

[52] U.S. Cl. ..... 415/55.1; 415/55.2; 415/55.3; 415/55.4; 415/21.31; 415/214.1; 417/423.14

[58] Field of Search ..... 415/55.1, 55.2, 415/55.3, 55.4, 213.1, 214.1; 417/423.14

[56] References Cited

U.S. PATENT DOCUMENTS 4,692,092 9/1987 Matsuda et al. ..... 415/143
4,958,984 9/1990 Aoi et al. ..... 415/55.1
5,399,075 3/1995 Frank et al. ..... 417/423.1
5,401,147 3/1995 Yu ..... 417/423.14

FOREIGN PATENT DOCUMENTS 2 243 250 10/1991 United Kingdom .

*Primary Examiner*—Edward K. Look
*Assistant Examiner*—Rhonda Barton
*Attorney, Agent, or Firm*—Michael J. Striker

[57] ABSTRACT

The insert part (12) is introduced into the tubular part (10) from one end and comes to butt, in the direction of the longitudinal axis (11) of the tubular part (10), against a stop (24). At its end into which the insert part (12) is pushed, the tubular part (10) exhibits a region (30) with increased outer cross section. An annular tool part (36) with an opening (38) is pushed over the tubular part (10), from its other end, the cross section of which opening is smaller than that of the region (30) of the tubular part (10) with increased outer cross section. The tool part (36) is drawn over the region (30) with increased outer cross section, with the result that said region (30) is forced radially inwards, plastic deformation taking place in the process, and comes to butt, against the insert part (12), in doing so fixing the latter in the direction of the longitudinal axis (11). The tubular part (10) is elastically expanded when the tool (36) is drawn over the region (30) with increased outer cross section and then springs back, as a result of which the retaining force on the insert part (12) is increased.

15 Claims, 3 Drawing Sheets

PROCESS FOR PRODUCING A CONNECTION OF AN INSERT PART TO A TUBULAR PART BY MEANS OF FLANGING

This appln is a Divisional of Ser. No. 08/699,931 and a continuation of Ser. No. 08/519,664 filed Aug. 25, 1995, abandoned.

BACKGROUND OF THE INVENTION

The invention is based on a process for producing a connection of an insert part to a tubular part by means of flanging.

Such a process is known, for example, by way of DE 40 13 032 A1. In this process, the insert part is designed as a lid which is introduced from one end of a tubular part designed as a housing. The lid comes to butt, in the direction of the longitudinal axis of the housing, against a stop in order to ensure precise positioning in the direction of the longitudinal axis. The housing border projecting beyond the lid in the direction of the longitudinal axis is then flanged radially inwards with respect to the longitudinal axis of the housing, plastic deformation taking place in the process, with the result that said border engages over the outer border of the lid and butts against the lid in the direction of the longitudinal axis. The lid is then fixed, in the direction of the longitudinal axis, between the stop and the flanged border of the housing. When the border of the housing is flanged, the housing is compressed in the direction of its longitudinal axis and springs up again to some extent after the flanging operation, as a result of which its retaining force of the flanging is reduced and, in unfavorable circumstances, may even become zero. In the case of the known connection of the lid to the housing by means of flanging, it is thus not ensured that the lid is fastened securely in the housing.

ADVANTAGES OF THE INVENTION

In contrast, the process according to the invention for producing the connection of an insert part to a tubular part by means of flanging with the features of claim 1 has the advantage that, when the flanging is produced, that is to say when the annular tool part is moved over the region of the tubular part with increased outer cross section, a tensile force acts on the tubular part, with the result that, by virtue of the recovery, of the tubular part, which takes place after production of the flanging, the retaining force on the insert part is further increased and thus secured fastening of the insert part in the tubular part is achieved.

BRIEF DESCRIPTION OF THE DRAWINGS

An exemplary embodiment of the invention is represented in the drawing and is explained in more detail in the following description.

DESCRIPTION OF THE PREFERRED EMBODIMENT

Figure 1:
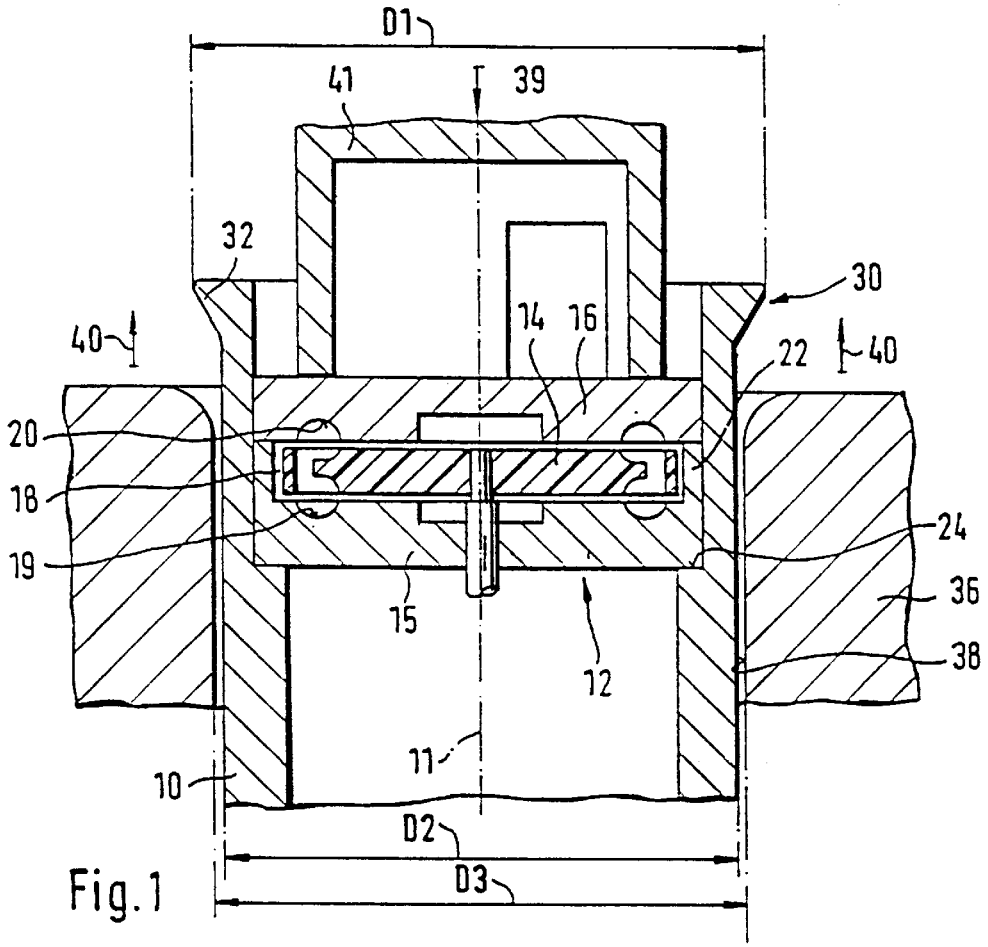
FIG. 1 shows an insert part and a tubular part in a first phase of the production of a flanged connection by means of a tool part.
Figure 2:
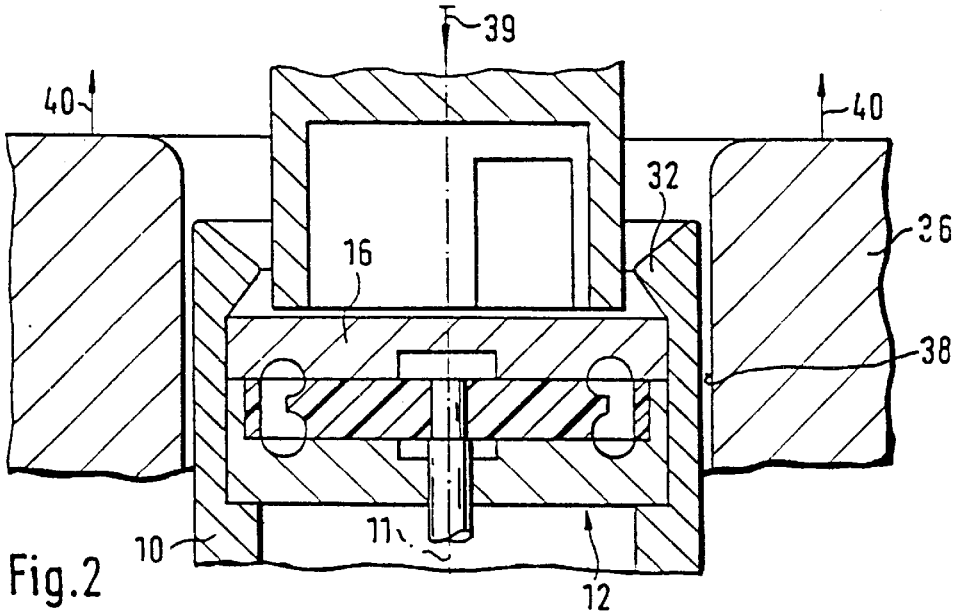
FIG. 2 shows the parts in a second phase of the production of the flanged connection.

A unit represented in FIGS. 1 and 2 exhibits a tubular part 10 and an insert part 12 which is fastened therein. The unit is a fuel-delivery unit for supplying an internal combustion engine of a motor vehicle with fuel. The tubular part 10 is a housing and the insert part 12 is a pump part which is inserted into the housing 10 from an end side. In addition to the pump part 12, an electric drive motor (not shown) is also accommodated in the housing 10. The pump part 12 is configured as a flow-pump part and exhibits an impeller 14 which is arranged in a pump chamber 18 which is bounded in the direction of the longitudinal axis 11 of the housing 10 by two wall parts 15 and 16. The wall parts 15 and 16 each exhibit, in their end sides facing the impeller 14, an annular delivery duct 19 and 20, which is arranged at the same diameter as the vanes of the impeller 14. A spacing is provided between the two wall parts 15 and 16, in the direction of the longitudinal axis 11 of the housing 10, in order to accommodate the impeller 14 in the pump chamber 18 with a defined degree of axial play. The inner wall part 15 exhibits a cylindrical extension 22 which bounds the pump chamber 18 in the radial direction with respect to the longitudinal axis 11 and against the end side of which the outer wall part 16 butts. In its end region in which the pump part 12 is arranged, the housing 10 is of a greater diameter than the rest of the housing, with the result that a step 24 which is arranged radially with respect to the longitudinal axis 11 of the housing 10 and is oriented towards the end of the housing 10 is formed at the transition between the larger and smaller diameters. The step 24 forms a stop against which the pump part 12 comes to butt, in the direction of the longitudinal axis 11, via the inner wall part 15. An axial stop for the pump part 12 may also be formed by a further component arranged in the housing 10.

Figure 3:
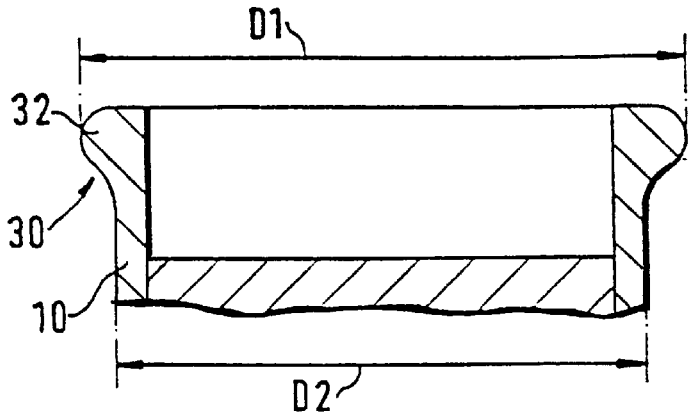
FIG. 3 shows a variant of the tubular part of FIG. 1.
Figure 4:
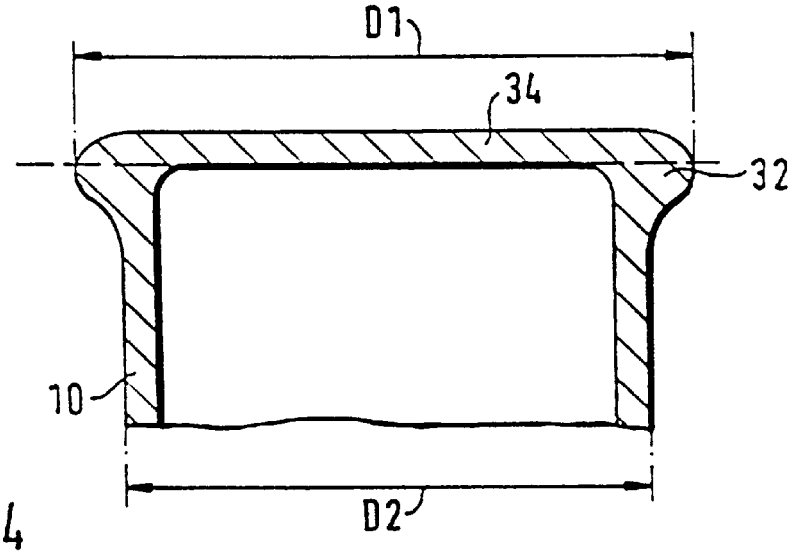
FIG. 4 shows a prefabrication stage of the tubular part.
Figure 5:
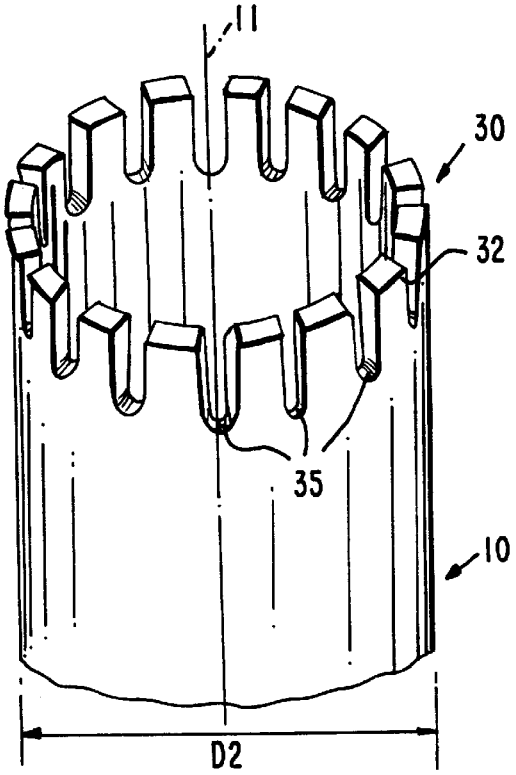
FIG. 5 shows a further variant of the tubular part.

The housing 10 is of a cross-sectionally circular design and exhibits, at its end into which the pump part 12 is introduced, a region 30 with an outer cross section which is increased with respect to the rest of the housing, in particular with an increased external diameter. The external diameter of the housing 10 in the region 30 is designated by D1 and the external diameter of the housing 10 in the remaining region adjoining the region 30 is designated by D2. The region 30 extends over the entire circumference of the housing 10 and forms, as it were, a ring, it also being possible, however, merely to provide, in the region 30, a plurality of protrusions which are distributed over the circumference of the housing 10 and project beyond the diameter D2 of the housing 10. In the region 30, the housing 10 exhibits, in order to form the increased external diameter, an outwardly protecting thickening 32, of which the diameter D1 increases towards the end of the housing 10. The external diameter D1 of the thickening 32 may increase, for example, conically, as is represented in FIG. 1, or may increase in a rounded manner, as is represented in FIG. 3. The housing 10 consists of a plastically deformable material, in particular metal, and may be produced, for example, by deep-drawing. In this arrangement, the housing 10 may, as is represented in FIG. 4, be designed initially in the form of a pot and be provided with a base 34 at its end into which the pump part 12 is introduced. In order to produce the thickening 32, the housing 10, after the deep-drawing operation, is upset at its end with the base 34, that is to say it is compressed in the direction of its longitudinal axis 11, with the result that the wall of the housing 10 is forced outwards, plastic deformation taking place in the process. The base 34 is then removed, as is marked by broken lines in FIG. 4, this resulting in a tubular part which is open at both of its ends. FIG. 5 represents a variant of the housing 10, in which said housing is designed essentially as has been described above, but exhibits, starting from its end into which the pump part 12 is introduced, one or more slits 35 extending approximately in the direction of the longitudinal axis 11. The slits 35 extend to beyond the thickening 32, into the region of the housing 10 with the diameter D2.

Figure 6:
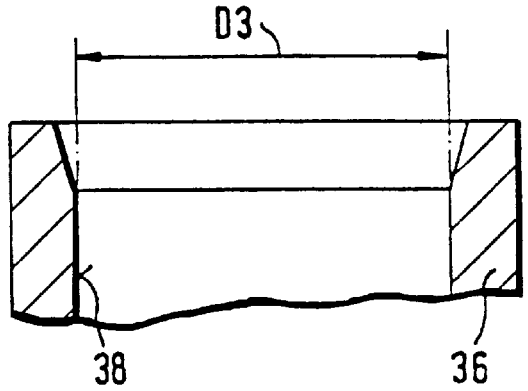
FIG. 6 shows a variant of an annular tool for producing the flanged connection.

FIG. 1 represents the housing 10, with the pump part 12 introduced therein, before the pump part 12 is fastened. An annular tool part 36, which has an opening 38, is pushed over the housing 10, from its end which is located opposite the thickening 32, the diameter D3 of which opening is only slightly greater than the diameter D2 of the housing 10 outside the thickening 32, with the result that the tool part 36 can be displaced on the housing 10 without a clamping effect. The tool part 36 may be arranged in a fixed manner as part of an apparatus, the housing 10 then being pushed into the opening 38 of said tool part in the direction of the arrow 39 in FIGS. 1 and 2, or the housing 10 can be braced in an apparatus, and the tool part 36 is then pushed onto the housing 10 in the direction of the arrows 40 in FIGS. 1 and 2. At its border which is oriented towards the thickening 32, the opening 38 of the tool part 36 is rounded such that it widens from the diameter D3, but it may also be designed, as is represented in FIG. 6, for example in a conical manner such that it widens from the diameter D3. The pump part 12 is held in abutment against the step 24, by way of its inner wall part 15, by means of a holding-down device 41 which acts on the outer wall part 16 of said pump part 12. A relative movement is then effected, in the direction of the longitudinal axis 11, between the housing 10 and the tool part 36, in that either the housing 10 is moved relative to the fixed tool part 36 or the tool part 36 is moved relative to the fixed housing 10. In this arrangement, the tool part 36 slides onto the thickening 32, this being facilitated by the rounded or beveled border of the opening 38 of the tool part 36 and the beveled or rounded rise of the thickening 32. The thickening 32 is, as is represented in FIG. 2, forced radially inwards with respect to the longitudinal axis 11 by the tool part 36, plastic deformation taking place in the process, and engages over the border of the outer wall part 16 of the pump part 12. Moreover, the inwardly forced thickening 32 acts on the outer wall part 16 in the direction of the longitudinal axis 11, with the result that the pump part 12 is held, in the direction of the longitudinal axis 11, between the step 24 and the thickening 32. The slits 35 of that variant of the housing 10 which is represented in FIG. 5 reduce the upsetting of the housing 10 in the circumferential direction and reduce the force which is necessary to move the tool part 36 over the thickening 32. During the period in which the tool part 36 is moved over the thickening 32, the housing 10 is stretched, that is to say a tensile force acts on the housing 10 in the direction of the longitudinal axis 11, by virtue of which tensile force the housing 10 is elastically expanded. After the thickening 32 has been forced inwards and the tool part 36 has moved beyond said thickening, the housing springs back again to some extent, that is to say the housing 10 is shortened again. In this arrangement, the force by which the pump part 12 is retained by the thickening 32 against the step 24 is further increased by the recovery of the housing 10 and thus more secure holding of the pump part 12 in the housing 10 is achieved. Finally, at its end in which the pump part 12 is arranged, the housing 10 also has an external diameter which is approximately as large as the diameter D3 of the opening 38 of the tool part 36 and is only slightly greater than the diameter D2 of the rest of the housing.

Figure 7:
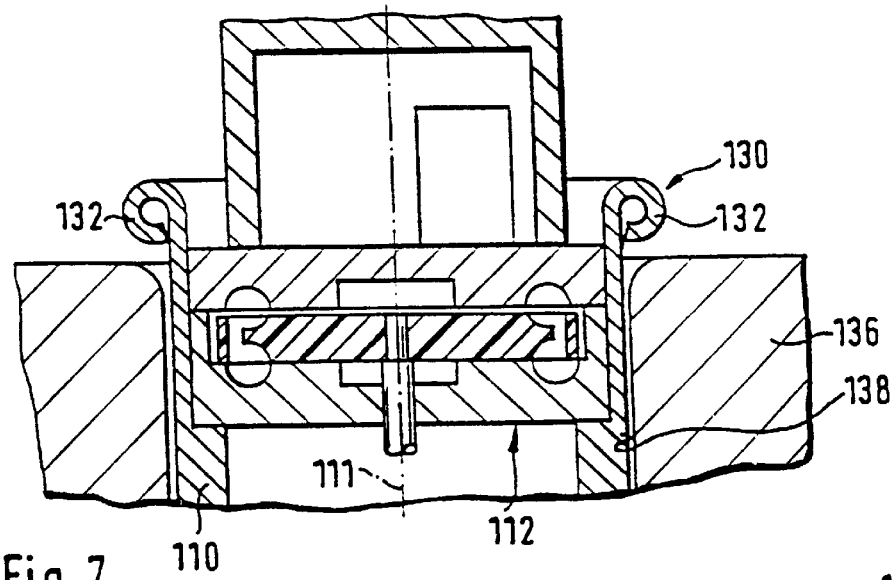
FIG. 7 shows a further configuration of the tubular part and FIG. 8 shows a variant of the tubular part of FIG. 7.
Figure 8:
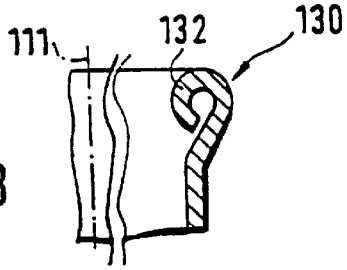

FIG. 7 represents a variant of the housing 110, in which, in order to form the region 130 with increased external diameter, the border 132 of the housing 110 is bent over outwards, at its end into which the pump part 112 is introduced, and rolled approximately through half a revolution. The rolled border 132 likewise forms an outwardly projecting thickening, which, however, is not solid. The rolled border 132 and the opening 138 of the annular tool part 136 are, in this arrangement, matched to one another such that when the tool part 136 is moved over the border 132, the border 132 is forced radially inwards and is not unrolled in the direction of the longitudinal axis 111 of the housing 110. This is achieved by a rounded or beveled progression of the rolled border 132 and/or the border of the opening 138 of the tool part 136. Moreover, a lubricant may be applied to the surface of the opening 138 of the tool part 136 and/or the surface of the rolled border 132 in order to ensure that there is only a small amount of friction present between these two parts. FIG. 8 represents a variant of the housing 110, in which the border 132 of the housing 110 is bent over inwards and rolled. In this arrangement, however, the housing 110 is widened, in terms of its inner cross section, in the region of the border 132 such that the pump part 112 can be introduced and the region 130 with increased outer cross section is formed.

As in the case of the configuration according to FIG. 5, at least one slit may also be provided in the region 130 in the embodiments of the housing 110 according to FIGS. 7 and 8.

The above described process for producing the connection of the pump part 12, 112 to the housing 10, 110 is not restricted to cross sectionally circular housings, but can be used with any cross sectional shapes of the housing. Here, the housing is generally of a greater outer cross section at its end into which the pump part is introduced than elsewhere. Correspondingly, the annular tool part exhibits an opening with a cross section which is somewhat smaller than the increased outer cross section of the housing and is somewhat greater than the outer cross section of the rest of the housing. When the tool part is moved over the region of the housing with increased outer cross section, then said region is forced radially inwards, plastic deformation taking place in the process. The process is likewise not restricted to use for the above described fuel-delivery unit, but may also be transferred to any application cases in which an insert part or a lid part is to be fastened in a tubular part by flanging.

I claim:

1. A process for producing a connection of an insert part which forms a pump part in a tubular part which forms a housing of a fuel-delivery pump for supplying fuel to an internal combustion engine of a motor vehicle by flanging, comprising the steps of inserting a pump part into a tubular housing from one end of the housing in a direction of a longitudinal axis of the housing so that the pump part comes to butt against a stop; flanging a projecting border of the tubular housing radially inward towards the longitudinal axis over the pump part so that the pump part is fixed in the direction of the longitudinal axis between the stop and the flanged border; providing in the housing at its end into which the pump part is introduced, a region at least over a part of a circumference of the housing with an outer section which is increased relative to a rest of the pump part; pushing an annular tool part with an opening over the housing from another end of the housing with a cross-section of the opening being smaller than the region of the housing with the increased outer cross-section and being at least as large as an outer cross-section of the rest of the housing; and performing a relative movement in direction of the longitudinal axis between the tool part and the housing with a result that the tool part is moved over the region of the housing with the increased outer cross-section, and the region of the housing with increased outer cross-section is forced radially inwardly toward the longitudinal axis outside the pump part with plastic deformation of the region of the housing with increased outer cross-section.

2. The process as defined in claim 1; and further comprising the step of holding the pump part in abutment against the stop by a holding-down device during moving of the tool part over the region of the housing with increased outer cross-section.

3. The process as defined in claim 1; and further comprising the step of fixing the tubular part in an apparatus; and moving the tool part relative to the housing.

4. The process as defined in claim 1; and further comprising the step of arranging the tool part in a fixed manner; and moving the housing relative to the tool part.

5. The process as defined in claim 1; and further comprising the step of forming the housing with a thickening so as to form the region with increased outer cross-section.

6. The process as defined in claim 5, wherein said step of forming includes producing the thickening by upsetting the housing.

7. The process as defined in claim 1; and further comprising the step of bending the housing over outward at its border so as to form the region with increased outer cross-section.

8. The process as defined in claim 7; and further comprising the step of rolling the bent-over border of the housing.

9. The process as defined in claim 1; and further comprising the step of bending the housing over inward at its border and widening the housing so as to form the region with increased outer cross-section.

10. The process as defined in claim 9; and further comprising the step of rolling the bent-over border of the housing.

11. The process as defined in claim 1; and further comprising the step of increasing the outer cross-section of the housing in the region of the increased cross-section toward an end of the housing.

12. The process as defined in claim 1; and further comprising the step of widening the opening of the tool part toward its border which is first to make contact with the region of the housing with increased outer cross-section.

13. The process as defined in claim 1; and further comprising the step of providing at least one slot in the housing at least in the region with increased outer cross-section so that the slot extends approximately in the direction of the longitudinal axis of the housing.

14. A process for producing a connection of an insert part which forms a pump part having two end faces in a tubular part which forms a housing by flanging, comprising the steps of inserting a pump part into a housing from one end of the housing in a direction of a longitudinal axis of the housing so that the pump part comes to butt with one of the axial faces against a stop; flanging a projection border of the housing radially inward towards the longitudinal axis over the insert part axially outside the pump part so that the flanged border abuts against the other end face of the pump part and thereby the pump part is fixed in the direction of the longitudinal axis between the stop and the flanged border; providing in the housing at its end into which the pump part is introduced, a region at least over a part of a circumference of the housing with an outer section which is increased relative to a rest of the housing; pushing an annular tool part with an opening over the housing from another end of the housing with a cross-section of the opening being smaller than the region of the housing with the increased outer cross-section and being at least as large as an outer cross-section of the rest of the housing; and performing a relative movement in direction of the longitudinal axis between the tool part and the housing with a result that the tool part is moved over the region of the housing with the increased outer cross-section, and the region of the housing with the increased outer cross-section is forced radially inward toward the longitudinal axis axially outside the pump part with plastic deformation of the region of the housing with the increased outer cross-section.

15. A fuel-delivery pump for supplying fuel to an internal combustion engine of a motor vehicle, comprising an insert part which forms a pump part; a tubular part which forms a housing in which said insert part is inserted; and means for producing a connection of said pump part in said housing by flanging, said producing means including a stop formed so that when said pump part is inserted into said housing from one end of said housing in a direction of a longitudinal axis of said housing, said pump part comes to butt against said stop, said producing means further including a projecting border of said housing flanged radially inwards toward the longitudinal axis over said pump part so that said pump part is fixed in the direction of the longitudinal axis between said stop and said flanged border, said producing means further including a region in an end of said housing into which said pump part is introduced, which region at least over a part of a circumference of said housing has an outer section which is increased relative to a rest of said housing, so that an annular tool part is pushed with an opening over said housing from another end of said housing with a cross-section of the opening being smaller than said region of said housing with the increased outer cross-section and being at least as large as an outer cross-section of the rest of said housing, and a relative movement is performed in direction of the longitudinal axis between the tool part and the housing with a result that the tool part is moved over said region of said housing with the increased outer cross-section, and said region of said housing with the increased cross-section is forced radially inwardly toward the longitudinal axis outside said pump part with plastic deformation of said region of said housing with increased outer cross-section.

* * * * *